US007642995B2

(12) United States Patent
Kim et al.

(10) Patent No.: US 7,642,995 B2
(45) Date of Patent: Jan. 5, 2010

(54) PLASMA DISPLAY PANEL DRIVING DEVICE AND METHOD

(75) Inventors: Jin-Sung Kim, Suwon-si (KR); Seung-Hun Chae, Suwon-si (KR); Jin-Ho Yang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 625 days.

(21) Appl. No.: 11/076,795

(22) Filed: Mar. 9, 2005

(65) Prior Publication Data

US 2005/0200567 A1 Sep. 15, 2005

(30) Foreign Application Priority Data

Mar. 10, 2004 (KR) ..... 10-2004-0016140

(51) Int. Cl.
*G09G 3/28* (2006.01)
*H01J 17/49* (2006.01)

(52) U.S. Cl. ..... 345/68; 345/60; 345/63; 345/204; 345/690; 313/567; 313/581; 313/582; 313/584; 313/585

(58) Field of Classification Search ..... 345/55, 345/60, 63, 68, 204, 690, 691, 694; 313/483, 313/484, 567, 581, 583, 584, 585, 582
See application file for complete search history.

(56) References Cited

U.S. PATENT DOCUMENTS 6,836,262 B2 * 12/2004 Hashimoto et al. ..... 345/60
7,006,057 B2 * 2/2006 Jin et al. ..... 345/60
2003/0025654 A1 2/2003 Jin et al.
2003/0174102 A1 9/2003 Jeong
2004/0021657 A1 * 2/2004 Kang et al. ..... 345/204
2004/0212557 A1 * 10/2004 Koo et al. ..... 345/60
2004/0212558 A1 * 10/2004 Son et al. ..... 345/60
2005/0219153 A1 * 10/2005 Kim et al. ..... 345/60

FOREIGN PATENT DOCUMENTS

CN 1405746 A 3/2003
CN 1450515 A 10/2003
JP 2002-156943 5/2002
JP 2002-258795 9/2002
JP 2003-345292 12/2003

OTHER PUBLICATIONS

Patent Abstracts of Japan, Publication No. 2002-156943, dated May 31, 2002, in the name of Dae Jin Myoung et al.
Patent Abstracts of Japan, Publication No. 2002-258795, dated Sep. 11, 2002, in the name of Hajime Honma et al.
Patent Abstracts of Japan, Publication No. 2003-345292, dated Dec. 3, 2003, in the name of Atsushi Yokoyama et al.

* cited by examiner

*Primary Examiner*—My-Chau T Tran
(74) *Attorney, Agent, or Firm*—Christie, Parker & Hale, LLP

(57) ABSTRACT

A plasma display panel driver. The driver uses a high side switch of a scan IC to increase a voltage width of an initialization waveform which is applied in the initial operation of the plasma display panel set. Accordingly, the initial screen is stably driven, and a voltage width is increased without additional installation of elements or an increase of a withstanding voltage switches.

20 Claims, 8 Drawing Sheets

PLASMA DISPLAY PANEL DRIVING DEVICE AND METHOD

CROSS REFERENCE TO RELATED APPLICATION

This application claims priority to and the benefit of Korean Patent Application No. 10-2004-0016140, filed on Mar. 10, 2004, the entire contents of which is incorporated herein by reference.

BACKGROUND OF THE INVENTION

1. Field of the Invention

The present invention relates to a plasma display panel (PDP) driver.

2. Discussion of the Related Art

Recently, liquid crystal displays (LCDs), field emission displays (FEDs), and plasma displays have been actively developed. Plasma displays have better luminance and light emission efficiency as compared to other types of flat panel devices, and they also have wider viewing angles. Therefore, the plasma displays have come into the spotlight as substitutes for the conventional cathode ray tubes (CRTs) in large displays of greater than 40 inches.

The plasma display is a flat display that uses plasma generated by a gas discharge process to display characters or images, and tens to millions of pixels are provided thereon in a matrix format, depending on its size. Plasma displays are categorized into DC plasma displays and AC plasma displays, according to supplied driving voltage waveforms and discharge cell structures.

Since the DC plasma displays have electrodes exposed in the discharge space, they allow a current to flow in the discharge space while the voltage is supplied, and therefore they problematically require resistors for current restriction. On the other hand, since the AC plasma displays have electrodes covered by a dielectric layer, capacitances are naturally formed to restrict the current, and the electrodes are protected from ion shocks during discharging. Accordingly, they have a longer lifespan than the DC plasma displays.

FIG. 1 shows a perspective view of an AC PDP. A scan electrode 4 and a sustain electrode 5, disposed over a dielectric layer 2 and a protection film 3, are provided in parallel and form a pair with each other under a first glass substrate 1. A plurality of address electrodes 8 covered with an insulation layer 7 are installed on a second glass substrate 6. Barrier ribs 9 are formed in parallel with the address electrodes 8, on the insulation layer 7 between the address electrodes 8, and phosphor 10 is formed on the surface of the insulation layer 7 between the barrier ribs 9. The first and second glass substrates 1, 6 having a discharge space 11 between them are provided facing each other so that the scan electrode 4 and the sustain electrode 5 may respectively cross the address electrode 8. The address electrode 8 and a discharge space 11 formed at a crossing point of the scan electrode 4 and the sustain electrode 5 form a discharge cell 12.

FIG. 2 shows a PDP electrode arrangement diagram for the AC PDP of FIG. 1. The PDP electrode arrangement has an m×n matrix configuration, with address electrodes A1 to Am in a column direction, and scan electrodes Y1 to Yn and sustain electrodes X1 to Xn in a row direction, alternately. The scan electrodes will be referred to as Y electrodes and the sustain electrodes as X electrodes hereinafter. The discharge cell 12 shown in FIG. 2 corresponds to the discharge cell 12 shown in FIG. 1.

Typically, the AC PDP driving method includes a reset period, an addressing period, and a sustain period according to temporally varied operations. FIG. 3 shows a conventional X and Y electrode waveform diagram. In the reset period wall charges caused by a previous sustain discharge are erased, and the cells are reset in order to stably perform a next address operation. In the address period, the cells that are turned on and the cells that are not turned on are selected on the panel, and wall charges are accumulated on the cells that are turned on (i.e., the addressed cells). In the sustain period, a discharge for actually displaying pictures on the addressed cells is performed by alternately applying a sustain discharge pulse Vs to the scan and sustain electrodes.

Conventionally, the same reset voltage is applied in all the reset periods. In this instance, a difference between the maximum voltage and the minimum voltage, that is, a voltage width, is substantially twice the discharge firing voltage. When initially driving a PDP set, the state of wall charges is varied depending on an operation when the PDP set is previously turned off or a time in which the turned-off state of the PDP set is maintained. Therefore, the cells may not be fully reset when a reset voltage which is the same as a reset voltage applied in a reset period in a normal operation is applied in an initial PDP set driving time.

It is possible to totally increase the reset voltage width in order to solve this problem. This, however, may apply an excessive reset voltage in the normal operation, increase a discharge amount of cells, increase background brightness, and thus degrade the contrast. Further, it increases a withstanding voltage of elements because of a high reset voltage, and increases a cost since an additional power supply for supplying a high voltage and a circuit are needed.

SUMMARY OF THE INVENTION

The present invention provides a PDP driving device and method for efficiently performing an initial reset operation without additional elements or an increase of withstanding voltage of the elements.

In one aspect of the present invention, a method is provided for driving a PDP having first electrodes, second electrodes, and panel capacitors provided between the first and second electrodes. In a reset period preceding an operating reset period, a first voltage is applied to the first electrode, the first voltage being higher than a predetermined voltage to be applied to the first electrode for the purpose of a sustain discharge. A waveform which gradually rises to a second voltage from the first voltage is applied to the first electrode. The voltage at the first electrode is reduced to a third voltage. A waveform which gradually falls to a fourth voltage from the third voltage is applied to the first electrode.

The reset period includes an initialization period preceding an operating reset period and performed before the plasma display panel is normally operated.

The third voltage may correspond to the first voltage. In addition, the third voltage may be applied to the first electrode for the purpose of the sustain discharge. A difference between the first voltage and a predetermined voltage is applied to the first electrode which is not selected in the address period.

In another aspect of the present invention, a PDP driver is provided for applying a voltage to a plurality of first electrodes, a plurality of second electrodes, and a plurality of panel capacitors formed by the first and second electrodes. The PDP driver includes a first transistor, a second transistor, a first capacitor, a third transistor, and a plurality of selecting circuits. The first transistor is coupled between a first power source for supplying a first voltage and the first electrode. The second transistor is coupled between a second power source for supplying a second voltage and the first electrode. The first capacitor has a first terminal coupled to a node of the first and second transistors, and charges a third voltage. The third transistor is coupled between a second terminal of the capacitor and the first electrode, and is operable to apply a rising waveform to the first electrode. The selecting circuits are coupled between both terminals of a second capacitor for charging a fourth voltage, and are operable to sequentially apply a scan voltage to the first electrodes in an address period. In a reset period, the first transistor is turned on to apply a fifth voltage to the first electrode through the selecting circuit, and the third transistor is turned on to apply a waveform which gradually rises to a sixth voltage to the first electrode. The reset period includes an initialization period performed before the plasma display panel is normally operated.

The fifth voltage corresponds to a sum of the first voltage and the fourth voltage. The sixth voltage corresponds to a sum of the first voltage, the fourth voltage, and the third voltage. The PDP driver further includes a fourth transistor coupled between the capacitor and the third transistor. The fourth transistor is turned off while a waveform rising to the sixth voltage is applied to the first electrode. A rising waveform is applied to the first electrode, the third transistor is turned off, and the fourth transistor is turned on to reduce the voltage at the first electrode to the fifth voltage. The selecting circuit includes a fifth transistor having a first terminal coupled to the first electrode, and a second terminal coupled to a first terminal of the second capacitor, and a sixth transistor having a first terminal coupled to the first electrode, and a second terminal coupled to a second terminal of the second capacitor. A rising waveform is applied to the first electrode, the third and fifth transistors are turned off, and the fourth and sixth transistors are turned on to gradually reduce the voltage at the first electrode to the first voltage.

DETAILED DESCRIPTION

Figure 4:
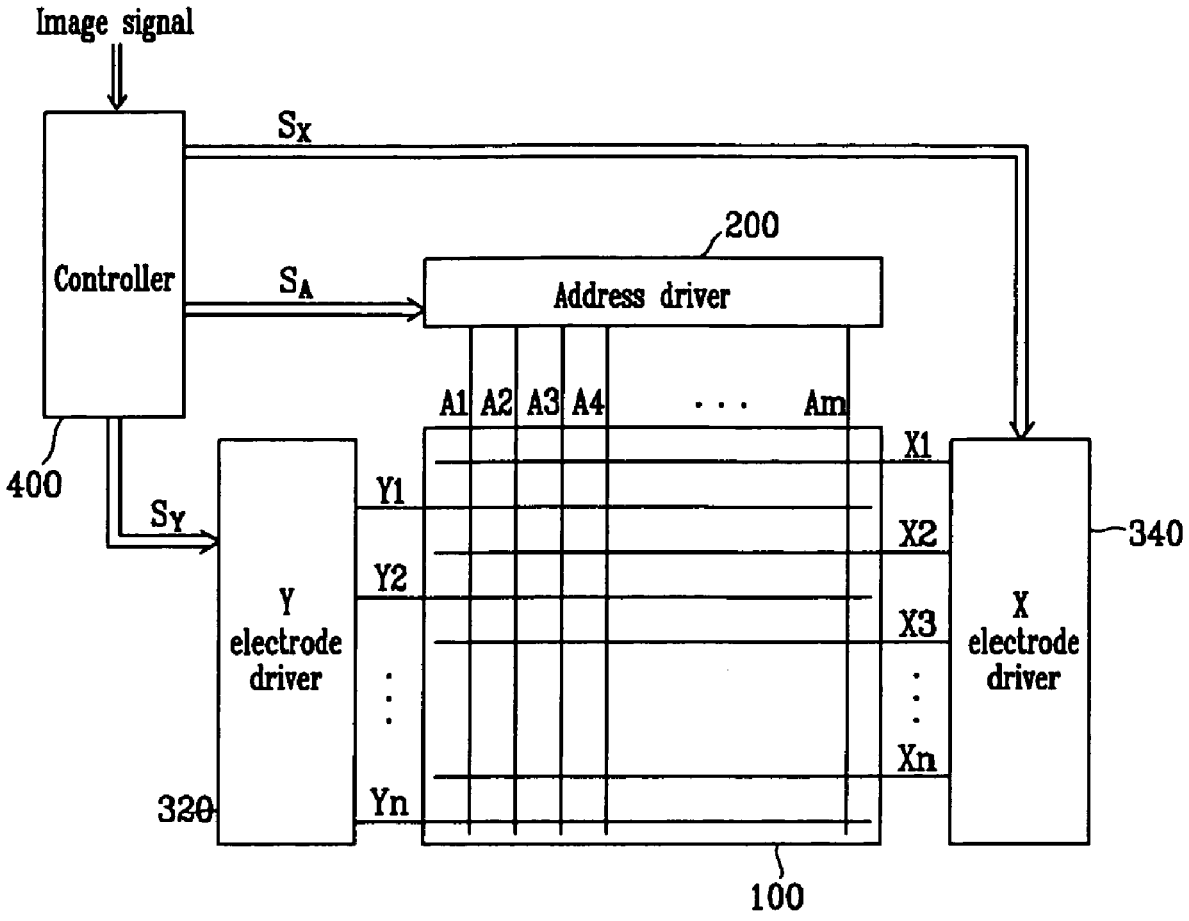
FIG. 4 shows a PDP according to an exemplary embodiment of the present invention.

Referring now to FIG. 4, the PDP includes a plasma panel 100, an address driver 200, a Y electrode driver 320, an X electrode driver 340, and a controller 400.

The plasma panel 100 includes a plurality of address electrodes A1 to Am arranged in a column direction, and a plurality of first electrodes Y1 to Yn (referred to as Y electrodes hereinafter) and second electrodes X1 to Xn (referred to as X electrodes hereinafter) arranged in a row direction.

The address driver 200 receives an address driving control signal ($S_A$) from the controller 400, and applies a display data signal for selecting a discharge cell to be displayed to each address electrode.

The Y electrode driver 320 and the X electrode driver 340 receive a Y electrode driving signal ($S_Y$) and an X electrode driving signals ($S_X$) from the controller 400 respectively, and apply them to the X electrodes and the Y electrodes.

The controller 400 receives an external image signal, generates an address driving control signal ($S_A$), a Y electrode driving signal ($S_Y$), and an X electrode driving signals ($S_X$), and transmits them to the address driver 200, the Y electrode driver 320 and the X electrode driver 340.

The controller 400 can perform a reset period (or an initialization period) for resetting the cells before the plasma display panel is normally operated after receiving power. The initialization period can be performed until a normal sync signal is input and the plasma display panel is normally operated.

The Y electrode driver 320 can apply an initialization waveform to the Y electrode at least once in the initialization period.

Figure 5:
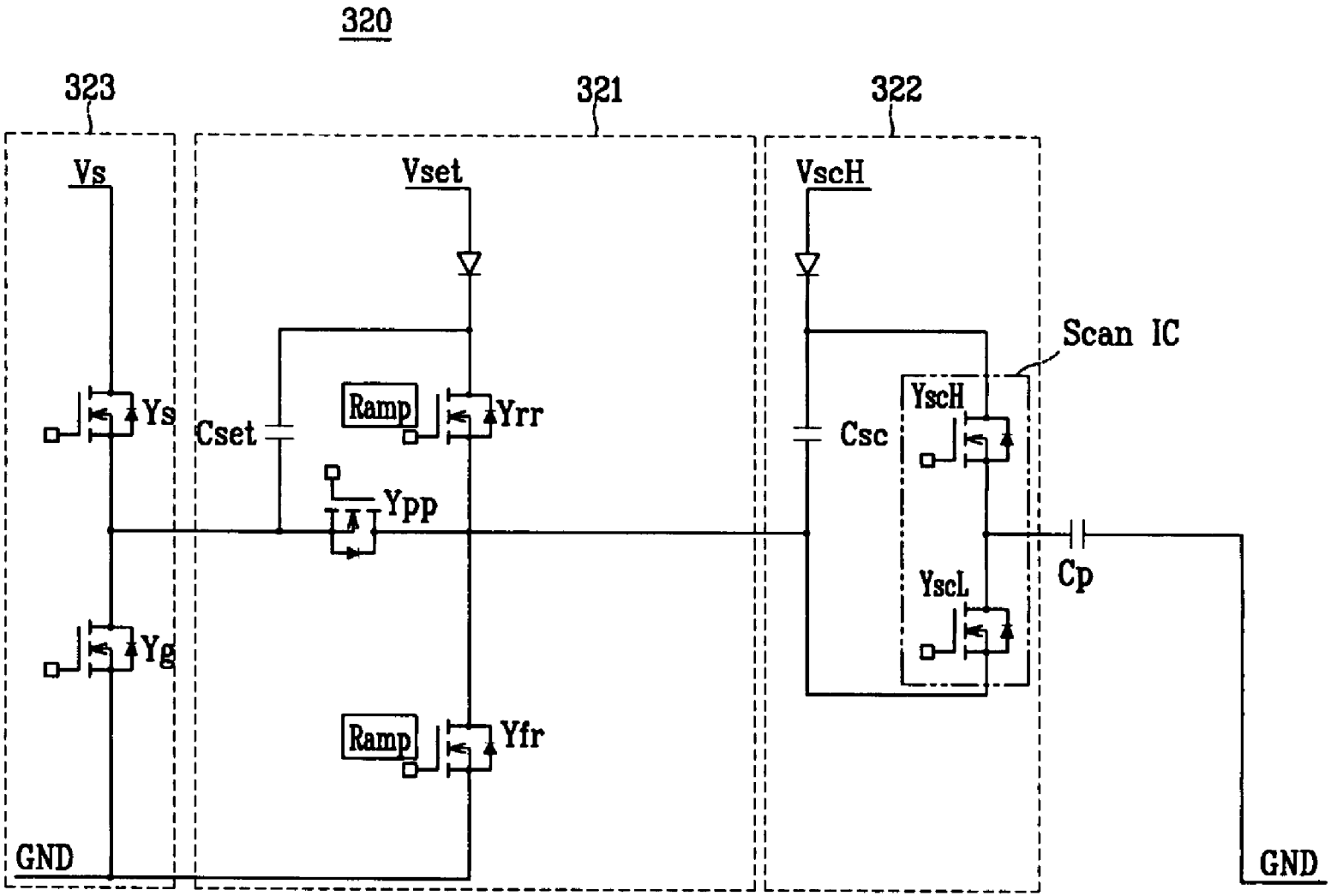
FIG. 5 shows a PDP Y electrode driving circuit diagram according to an exemplary embodiment of the present invention.

FIG. 5 shows the PDP Y electrode driver 320 diagram according to an exemplary embodiment of the present invention. The Y electrode driver 320 includes a reset driver 321, a scan driver 322, and a sustain driver 323.

The reset driver 321 includes a rising ramp switch Yrr for generating a rising reset waveform, a falling ramp switch Yfr for generating a falling ramp waveform in a reset period, a power source Vset, a capacitor Cset charged with the voltage Vset and operable as a floating power source, and a switch Ypp formed on a main path to prevent a reverse current.

The scan driver 322 generates a scan pulse in the address period, and includes a power source VscH for supplying a voltage to a scan electrode which is not selected, a capacitor Csc for storing the voltage VscH, and a plurality of scan driver ICs coupled to the Y electrodes. The scan driver IC includes a switch YscH for supplying the high voltage VscH to the panel capacitor Cp, and a switch YscL for supplying a low voltage 0V.

The sustain driver 323 generates a sustain discharge pulse in the sustain period, and includes switches Ys and Yg coupled between the power source Vs and the ground GND.

In this instance, the panel capacitor Cp equivalently illustrates a capacitance component between the X electrode and the Y electrode. Also, for ease of description, the X electrode of the capacitor Cp is depicted to be coupled to the ground terminal, but the X electrode is actually coupled to the X electrode driver 340.

The process for the Y electrode driver 320 to apply an initialization waveform to the panel capacitor Cp in an initialization operation will now be described with reference to FIGS. 6A and 6B.

Figure 6A:
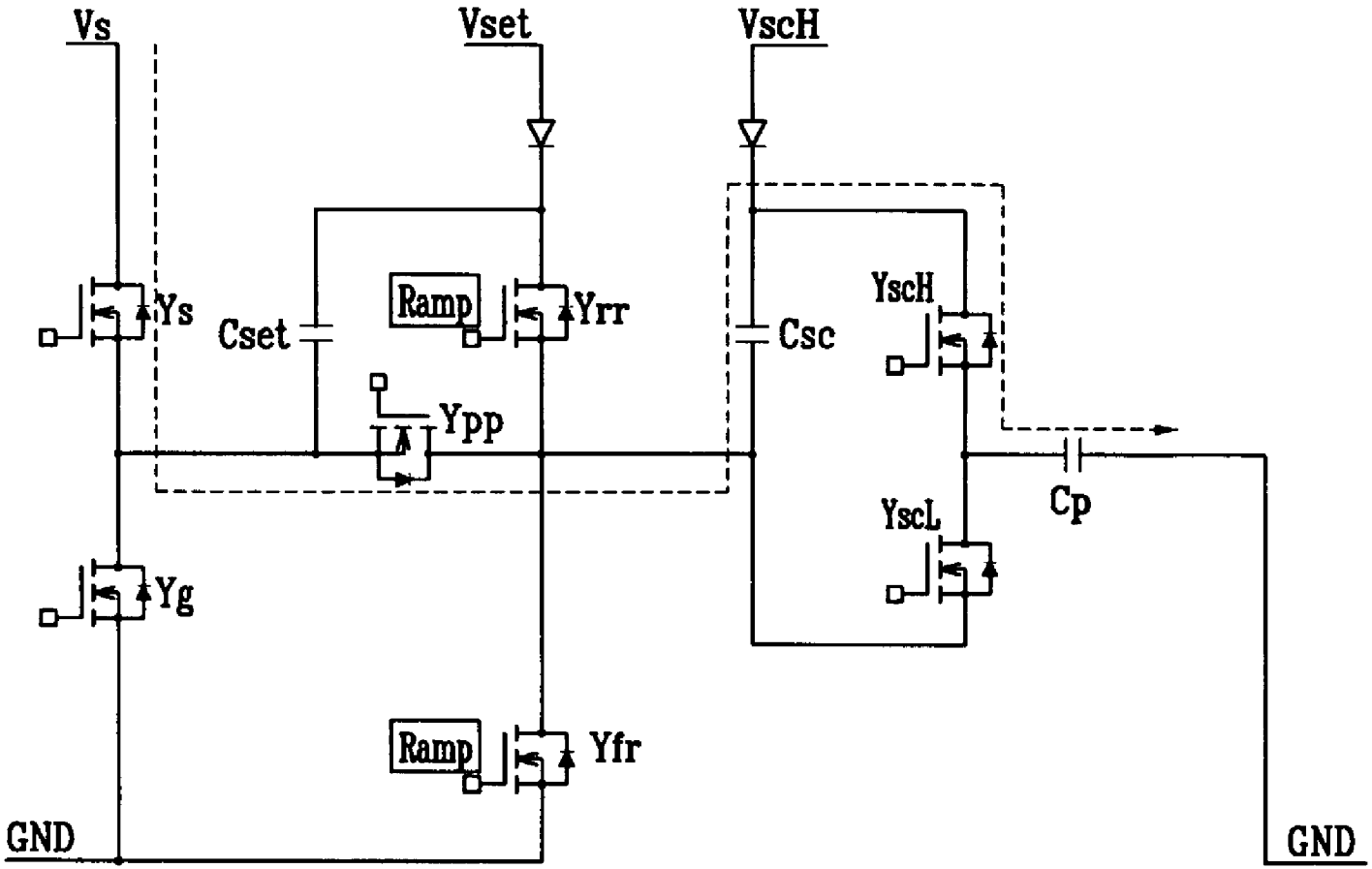
FIGS. 6A and 6B show current paths when a reset waveform is applied in a Y electrode driver according to an exemplary embodiment of the present invention.
Figure 6B:
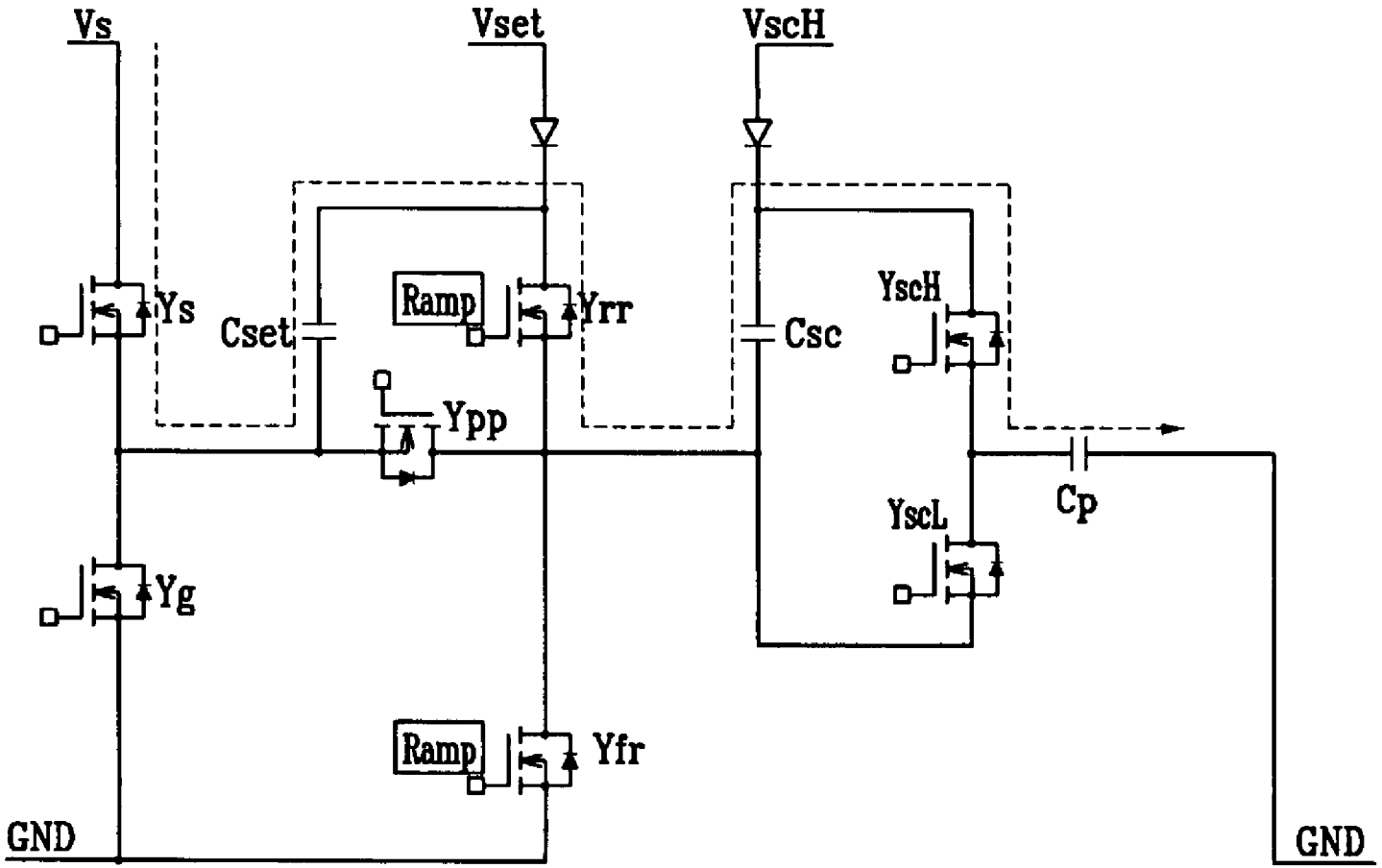

FIGS. 6A and 6B show current paths when the Y electrode driver 320 applies an initialization waveform to the Y electrode of the panel capacitor Cp according to the first exemplary embodiment of the present invention. In FIG. 6A, the switch Ys and the high side switch YscH are turned on. In this instance, the voltage (Vs+VscH) is applied to the Y electrode of the capacitor Cp through the switch YscH since the capacitor Csc is charged with the voltage VscH. In FIG. 6B, when the switch Yrr is turned on while the switch Ypp is turned off and the switches Ys and YscH are turned on, the voltage rising to the voltage (Vs+VscH+Vset) from the voltage (Vs+VscH) is applied to the Y electrode by the floating voltage Vset.

When the switch Yrr is turned off, the voltage at the Y electrode falls to the voltage (Vs+VscH) through the path of FIG. 6A.

When the switch Ys is turned off and the switch Yfr is turned on, a falling ramp waveform gradually falling to the voltage 0V from the voltage (Vs+VscH) is applied to the Y electrode through the path formed in the order of the panel capacitor Cp, the switch YscH, the capacitor Csc, the switch Yfr, and the ground GND.

The voltage at the Y electrode is reduced to the voltage (Vs+VscH) from the voltage (Vs+VscH+Vset) and the falling ramp waveform is applied in the first embodiment.

Alternatively, according to a second exemplary embodiment, a falling ramp start voltage can be reduced to the voltage Vs. That is, the voltage at the Y electrode is reduced to the voltage Vs when the switches Yrr and YscH are turned off and the switch YscL is turned on before a falling ramp waveform is applied to the Y electrode.

In this state, when the switch Ys is turned off and the switch Yfr is turned on, a falling ramp waveform gradually falling to the voltage 0V from the voltage Vs is applied to the Y electrode through the path formed in the order of the panel capacitor Cp, the switch YscL, the switch Yfr, and the ground GND.

Figure 1:
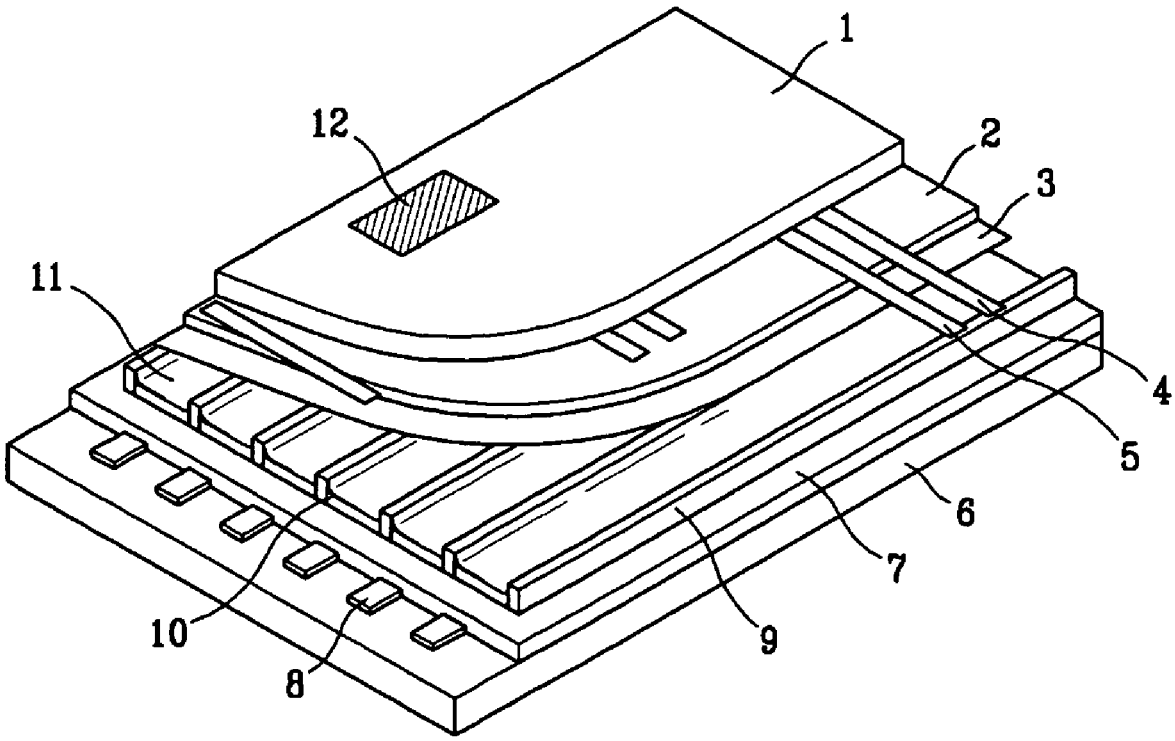
FIG. 1 (Prior Art)
FIG. 1 shows a perspective view of a conventional AC PDP.
Figure 2:
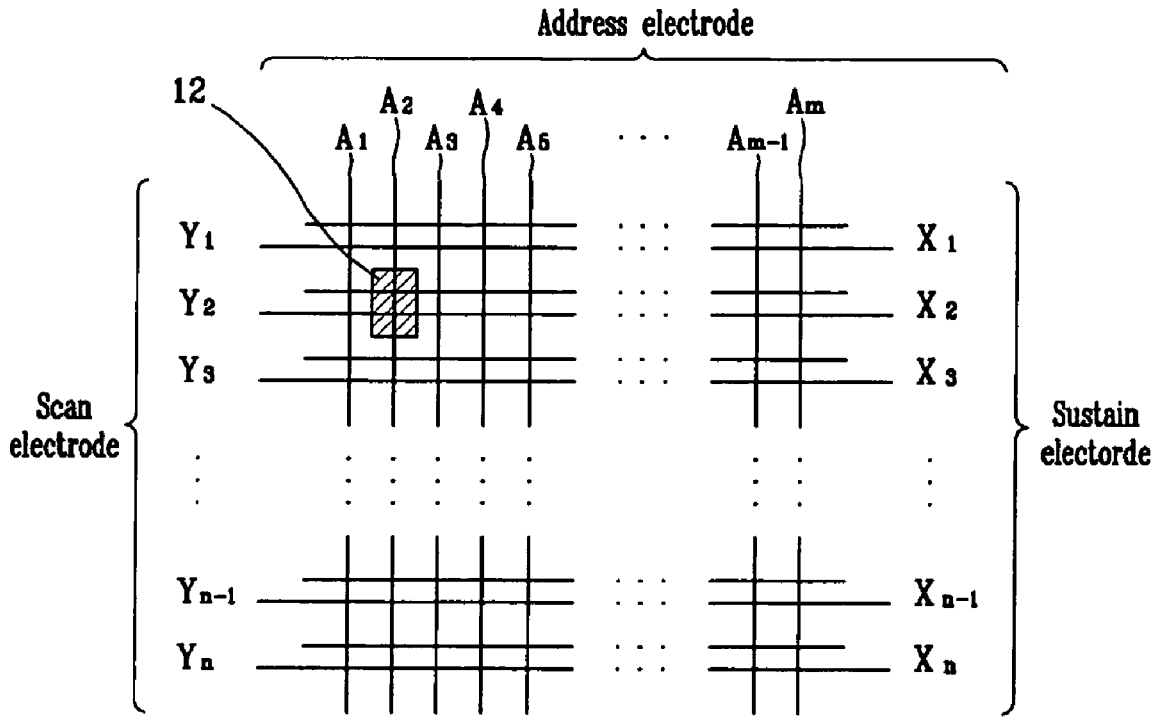
FIG.2(Prior Art)
FIG. 2 shows a PDP electrode arrangement diagram of the conventional AC PDP of FIG. 1.
Figure 3:
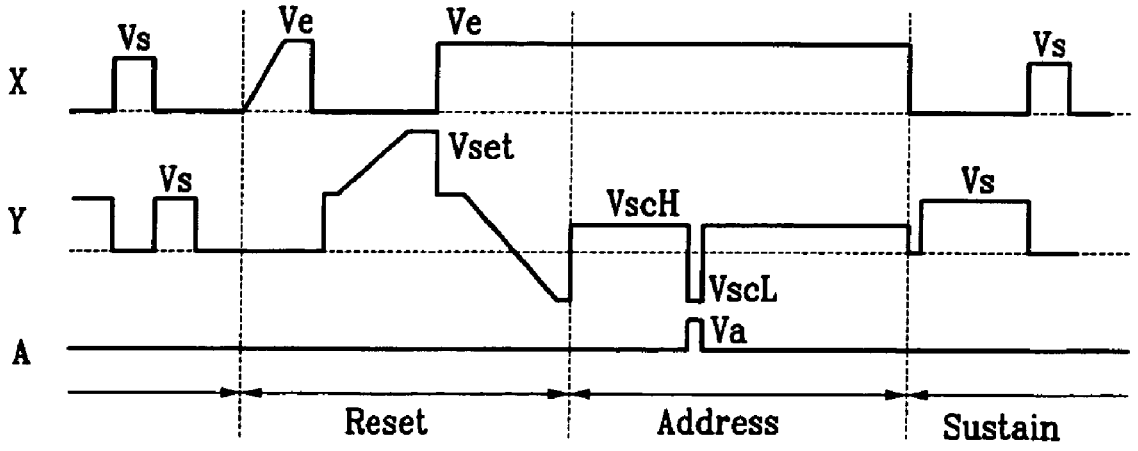
FIG.3(Prior Art)
FIG. 3 shows a conventional PDP driving waveform diagram.

A reset waveform applied when a sync signal is applied and the PDP set is normally operated follows the waveform of FIG. 3, and the waveform is applied through the low side switch YscL of the scan IC.

Figure 7A:
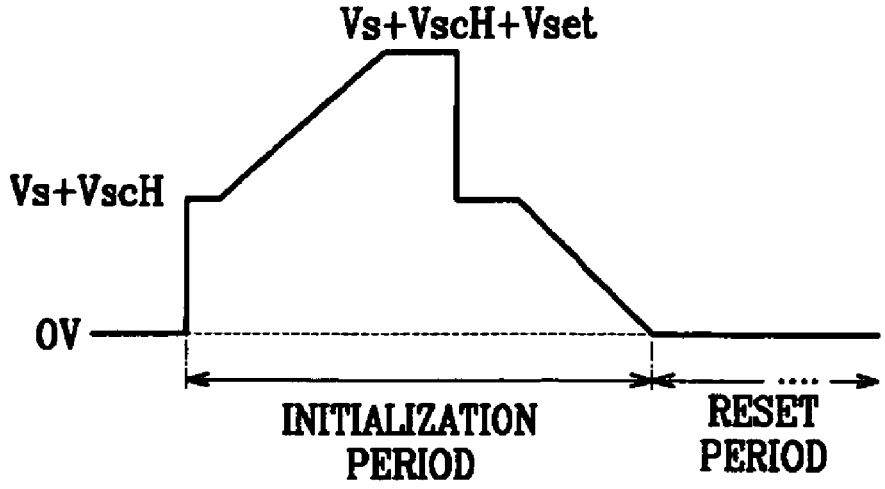
FIG. 7A shows a first reset pulse waveform diagram applied to a Y electrode of a panel capacitor Cp according to a first exemplary embodiment of the present invention.
Figure 7B:
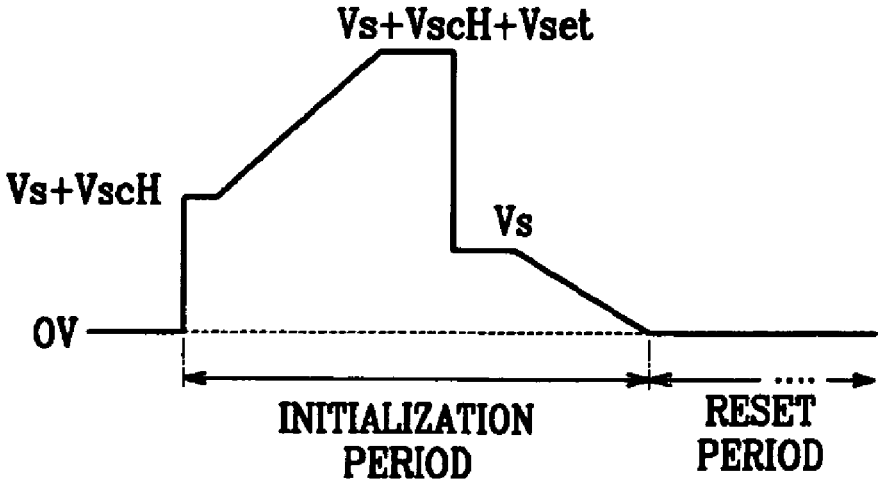
FIG. 7B shows a first reset pulse waveform diagram applied to a Y electrode of a panel capacitor Cp according to a second exemplary embodiment of the present invention.

FIGS. 7A and 7B show initialization waveforms applied to the Y electrode of the panel capacitor Cp by the Y electrode driver 320 according to the first and second exemplary embodiments of the present invention.

As shown therein, the starting voltage (Vs+VscH) for applying the initialization waveform is increased by as much as the voltage VscH as compared to the conventional voltage Vs when the PDP set is initially driven, thereby increasing the voltage width. Therefore, when the initialization waveform is repeatedly applied before the sync signal is applied, the cells which cannot be initialized by the starting voltage using the reset waveform applied during the normal operation, can be sufficiently initialized to thus display a stable initial screen in the normal operation.

Figure 8A:
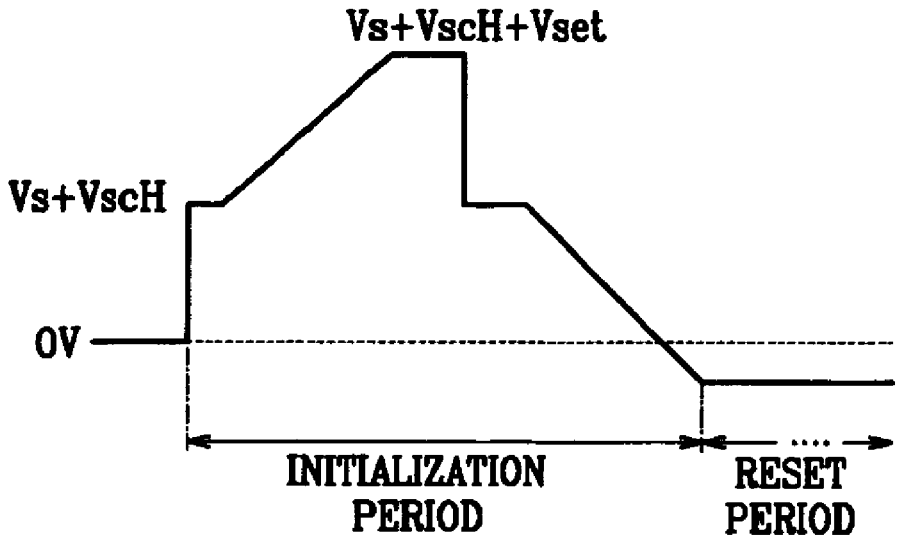
FIG. 8A shows a first reset pulse waveform diagram applied to a Y electrode of a panel capacitor Cp according to a third exemplary embodiment of the present invention.
Figure 8B:
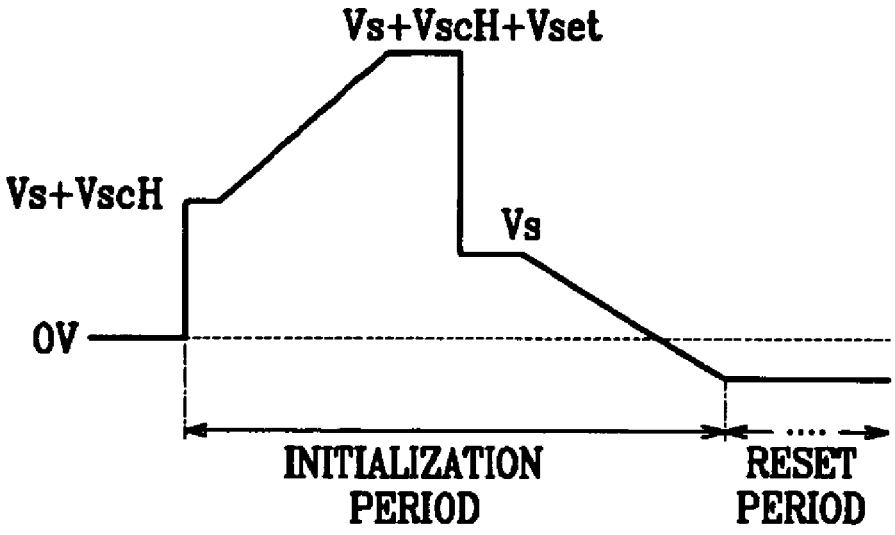
FIG. 8B shows a first reset pulse waveform diagram applied to a Y electrode of a panel capacitor Cp according to a fourth exemplary embodiment of the present invention.

When the final voltage of the falling ramp waveform is reduced to be lower than 0V, the voltage difference between the Y electrode and the X electrode is further increased and the initialization process of the discharge cells is performed more accurately, which are illustrated by FIGS. 8A and 8B for showing reset pulse waveforms at the initial drive according to third and fourth exemplary embodiments of the present invention.

As described, the initial screen is stably driven by increasing the initialization waveform width applied during the initial operation of the PDP set to be greater than the reset voltage width during the normal operation, and the voltage width is increased without additional installation of elements or an increase of withstanding voltage of elements, by using the high side switch of the scan IC.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel having a first electrode and a second electrode, comprising:

in a reset period, (a) applying a first voltage to the first electrode, the first voltage being higher than a peak voltage of a sustain discharge pulse applied to the first electrode;

(b) applying a waveform which gradually rises to a second voltage from the first voltage to the first electrode;

(c) reducing the voltage at the first electrode to a third voltage; and (d) applying a waveform which gradually falls to a fourth voltage from the third voltage to the first electrode.

2. A method for driving a plasma display panel having first electrodes, second electrodes, and panel capacitors provided between the first electrodes and the second electrodes, comprising:

in a reset period, (a) applying a first voltage to the first electrode, the first voltage being higher than a predetermined voltage to be applied to the first electrode for the purpose of a sustain discharge;

(b) applying a waveform which gradually rises to a second voltage from the first voltage to the first electrode;

(c) reducing the voltage at the first electrode to a third voltage; and (d) applying a waveform which gradually falls to a fourth voltage from the third voltage to the first electrode, wherein the reset period is an initialization period preceding an operating reset period and is performed before the plasma display panel is normally operated.

3. The method of claim 1, wherein the third voltage is substantially the same as the first voltage.

4. The method of claim 1, wherein the third voltage is substantially the same as the peak voltage of the sustain discharge pulse.

5. The method of claim 1, wherein a difference between the first voltage and the peak voltage of the sustain discharge pulse is applied to the first electrode, wherein the first electrode is not selected in the address period.

6. The method of claim 3, wherein a difference between the first voltage and the peak voltage of the sustain discharge pulse is applied to the first electrode, wherein the first electrode is not selected in the address period.

7. The method of claim 4, wherein a difference between the first voltage and the peak voltage of the sustain discharge pulse is applied to the first electrode, wherein the first electrode is not selected in the address period.

8. A plasma display panel driver for applying a voltage to a plurality of first electrodes, a plurality of second electrodes, comprising:

a first transistor coupled between a first power source for supplying a first voltage and the first electrode;

a second transistor coupled between a second power source for supplying a second voltage and the first electrode;

a first capacitor having a first terminal coupled to a node of the first and second transistors, the first capacitor charging a third voltage;

a third transistor coupled between a second terminal of the first capacitor and the first electrode, and operable to apply a rising waveform to the first electrode; and a plurality of selecting circuits coupled between both terminals of a second capacitor for charging a fourth voltage, and operable to sequentially apply a scan voltage to the first electrodes in an address period, wherein, in an initialization period preceding an operating reset period, the first transistor is turned on to apply a fifth voltage to the first electrode through the selecting circuit, and the third transistor is turned on to apply a waveform which gradually rises to a sixth voltage to the first electrode.

9. The plasma display panel driver of claim 8, wherein the initialization period is performed before the plasma display panel is normally operated.

10. The plasma display panel driver of claim 8, wherein the fifth voltage corresponds to a sum of the first voltage and the fourth voltage.

11. The plasma display panel driver of claim 8, wherein the sixth voltage corresponds to a sum of the first voltage, the fourth voltage, and the third voltage.

12. The plasma display panel driver of claim 8, further comprising a fourth transistor coupled between the first capacitor and the third transistor.

13. The plasma display panel driver of claim 12, wherein the fourth transistor is turned off while a waveform rising to the sixth voltage is applied to the first electrode.

14. The plasma display panel driver of claim 8, wherein a rising waveform is applied to the first electrode, the third transistor is turned off, and the fourth transistor is turned on to reduce the voltage at the first electrode to the fifth voltage.

15. The plasma display panel driver of claim 8, wherein the selecting circuit comprises:

a fifth transistor having a first terminal coupled to the first electrode, and a second terminal coupled to a first terminal of the second capacitor; and a sixth transistor having a first terminal coupled to the first electrode, and a second terminal coupled to a second terminal of the second capacitor.

16. The plasma display panel driver of claim 15, wherein a rising waveform is applied to the first electrode, the third and fifth transistors are turned off, and the fourth and sixth transistors are turned on to gradually reduce the voltage at the first electrode to the first voltage.

17. A method of initializing scan electrodes of a plasma display panel, comprising:

in sequence during an initialization period preceding an operating reset period:

applying to the scan electrodes a first initialization voltage higher than a sustain discharge voltage;

rising the first initialization voltage to a second initialization voltage, the second initialization voltage being higher than a reset voltage for the reset operating period;

reducing the second initialization voltage to a third initialization voltage; and reducing the third initialization to a fourth initialization voltage.

18. The method of claim 17, wherein the first initialization voltage has a voltage level the same as the third initialization voltage.

19. The method of claim 17, wherein the third initialization voltage has a voltage level the same as the sustain discharge voltage.

20. The method of claim 17, wherein the fourth initialization voltage is equal to or less than 0V.

* * * * *